United States Patent [19]

Bertini

[11] 4,399,803

[45] Aug. 23, 1983

[54] TARGET LAUNCHER

[76] Inventor: Milo Bertini, 679 Garden St., Trumbull, Conn. 06611

[21] Appl. No.: 290,209

[22] Filed: Aug. 5, 1981

[51] Int. Cl.[3] ..... F41B 15/00

[52] U.S. Cl. ..... 124/1; 124/41 R; 46/82; 46/269

[58] Field of Search ..... 124/6, 32, 1, 41 R; 46/82, 248, 249, 269

[56] References Cited

U.S. PATENT DOCUMENTS

| | | | |
|---|---|---|---|
| 3,130,717 | 4/1964 | De Lossy et al. | 124/1 |
| 3,570,467 | 6/1967 | Belokin | 124/41 R X |
| 4,077,384 | 3/1978 | Montefeltro | 124/1 |

*Primary Examiner*—Richard C. Pinkham

*Assistant Examiner*—William R. Browne

*Attorney, Agent, or Firm*—Arthur T. Fattibene

[57] ABSTRACT

A target launcher for launching a target in the form of a propeller-shaped, air foil or wing having a reversible motor with a launching head connected to the end of the motor shaft and which head includes a holder for releasably supporting thereon the propeller-shaped target. The motor is energized by a control circuit, which when activated, will effect rotation of the motor in one direction to retain the target in place on the launching head and to effect the release of the target when circuit is activated to reverse the direction of the motor. To vary the point of release of the target, the reversible motor is mounted to oscillate or rotate in as much as the motor is activated.

10 Claims, 4 Drawing Figures

TARGET LAUNCHER

RELATED PATENTS AND APPLICATIONS

This application relates to an improvement to target launchers for launching a propeller-shaped, air-foil target of the type described in my co-pending patent application, Ser. No. 239,972, filed Mar. 3, 1981, for Improved Target Pigeon Launcher; and to the patents and patent applications therein referred to.

PRIOR ART

There are known various launcher constructions for launching a propeller shaped, air foil or wing type targets such as disclosed in U.S. Pat. Nos. 4,077,384; 4,133,532; 4,205,651 and 4,206,914 and as disclosed and described in my co-pending patent application Ser. No. 239,972, filed Mar. 3, 1981 for Improved Target Pigeon Launcher. While the launchers of the type to which this invention relates, as noted in the foregoing patents and patent applications, performed satisfactorily, their respective constructions required considerable manufacturing operations and assembly which resulted in a relatively high manufacturing cost and consequently a relatively high selling cost. Also, the inherent construction of the prior known launchers required many mechanical moving parts and operating components, all of which involved numerous manufacturing and assembly operations.

OBJECTS

An object of this invention is to provide an improved launcher for launching propeller-shaped targets having a construction which is greatly simplified over the existing known target launchers and which is more easily manufactured and therefore more economical to construct.

Another object is to provide an improved target launcher wherein the target is released from the launcher simply by reversing the polarity of the launcher motor to reverse the direction of motor rotation.

Another object is to provide a target launcher which can be remotely actuated in a simple and expedient manner.

Another object is to provide a target launcher which can be safely loaded and actuated.

BRIEF SUMMARY OF THE INVENTION

The foregoing objects and other features and advantages are attained by a launcher which includes a support base having rotatably journal thereon a motor mount for supporting thereon a reversible motor. Disposed in the base of the launcher is a motor driven eccentric and a connecting rod or link assembly for effecting oscillation of the reversible motor through a predetermined angular sector in asmuth.

Mounted on the end of the shaft of the reversible motor is a launching head which includes a hub which it is fixed to the shaft. The front or face of the hub has connected thereto a projecting beak having an angular or offset nose portion. Disposed to opposite sides of the beak and projecting forwardly of the face of the hub are a pair of fingers which are laterally disposed and directed toward one another for retaining therebetween the propeller-shaped air foil. A normally spring-biased detent is disposed to one side of the target to retain the target in position between the opposed fingers as long as the motor is rotating in one direction. The arrangement is such that as long as the motor is rotating in one direction to impart rotation to the target, the target it retained to the launching hub. To effect the release of the target, the direction of rotation of the motor is reversed. The rapid reversal of the motor causes the fingers to be rotated or displaced relative to the target an amount sufficient to effect release of the target free of the fingers.

The operation of the launcher is remotely controlled by an electric circuit which includes the reversible motor of the launcher, the drive motor for oscillating the reversible motor in a predetermined sector in asmuth, and an indicating light for indicating the ready or loaded position of the launcher. A main power switch is physically located at the loading station so that the loader can safely cut the power to the launcher during a loading operation. Upon completion of the loading operation, the loader closes the main power switch which energizes an indicating light and readies the launcher for launching a target. At a firing station an operator closes a first switch or actuator which will energize the reversible motor and the drive motor causing the target to rotate and to oscillate in asmuth. To release the target, a second switch or actuator is closed which will effect the reversal of the reversible motor causing the target to override the detent and to be released from its retaining fingers. A relay or other electrical device is included in the circuit with the motor and actuator to reverse the polarity of the main motor so as to effect the controlled release of the target.

FEATURES

A feature of this invention resides in the provision of a target launcher which includes a reversible motor in which the release of the target is effected by reversing the rotation of the motor.

Another feature resides in a control circuit for a launcher having a main cut-off switch diposed in circuit with an indicating light for indicating when the launcher is readied for firing and a pair of actuating switches for sequentially imparting rotational energy to the target followed by a release thereof.

Another feature resides in the provision of a simplified launcher having a launching head constructed so as to effect the release of the target therefrom by solely controlling the direction of rotation thereof.

Another feature resides in a remotely controlled launcher which can be safely loaded by an operator at one station and which can be fired by another operator, when desired, located at a station remotely disposed from the loader.

Another features resides in the provision of a launcher having a medium of movable mechanical components.

Other features and advantages will become more readily apparent when considered in view of the drawings and specifications in which.

DETAILED SPECIFICATION

Figure 3:
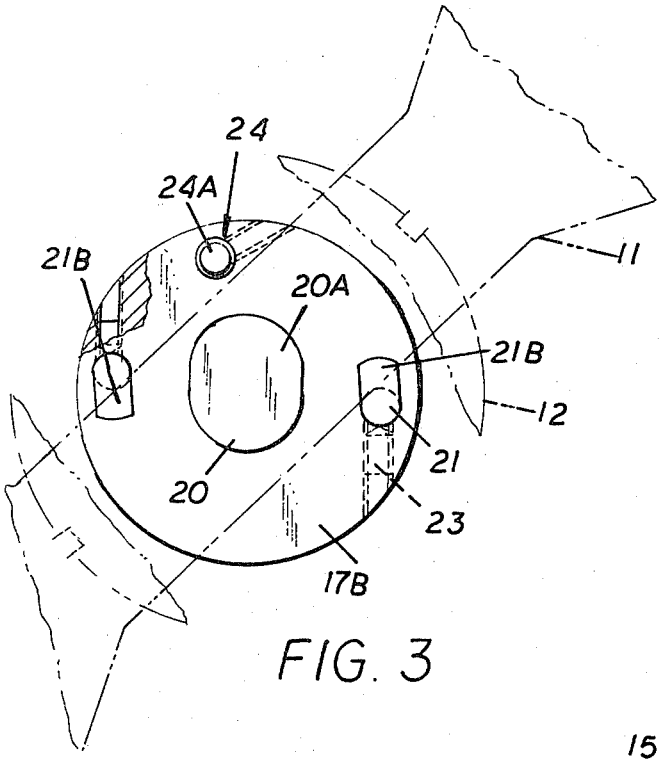
FIG. 3 is a front end view of the launch head and illustrating the propeller-shaped target in the retained position thereon.
Figure 2:
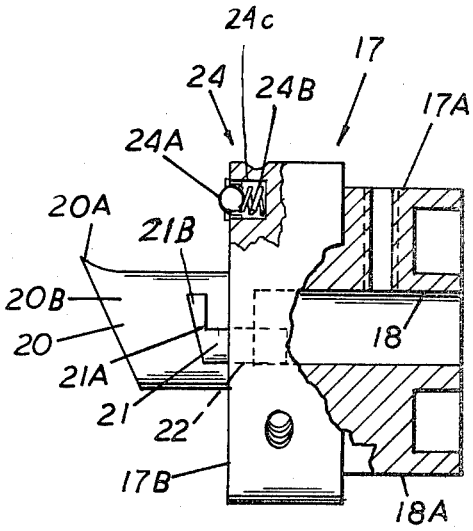
FIG. 2 is a detailed side view of the launcher head, having parts shown in section.
Figure 1:
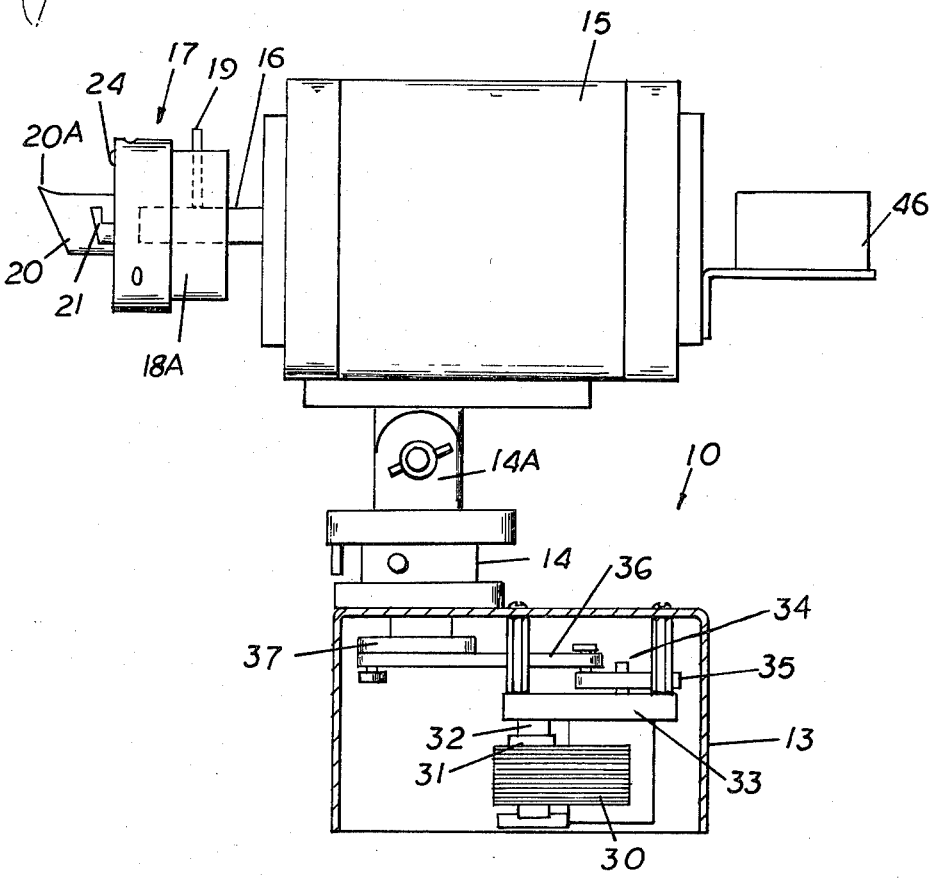
FIG. 1 is a side elevation view of the launcher embodying the present invention having parts shown in section.

Referring to the drawings, there is shown in FIGS. 1 to 3 a launcher 10 embodying the present invention. The launcher is particularly suited for launching propeller-shaped, air-foil wing type targets, preferrably of the type disclosed in my co-pending application Ser. No. 228,088, filed Jan. 26, 1981. Such target comprises of a propeller shaped, air foil 11 having a readily detachable witness cap or cup 12 which is constructed to separate from the air foil wing 11 when hit.

The instant launcher comprises a support base 13 in which the means for oscillating the launcher are housed as will be hereinafter described. Rotatably journalled on the base 13 is a motor mount 14 which is in the form of a vertical shaft which is provided with a forked or bifurcated upper end portion 14A. Pivotably connected to the upper end portion 14A of the motor mount 14 is a reversible, electric motor 15. The electric motor 15 is provided with a motor shaft 16 and a suitably wound armature which will effect the drive of the motor shaft 16 in either a clockwise or counterclockwise rotation, when actuated as will be hereinafter described.

Connected to the end of the motor shaft 16 is a launching head 17. The launching head 17 includes a hub portion 18A which has an axial bore 18 arranged to receive the end of the motor shaft 16. A set screw or other suitable fastener 19 secures the launching head 17 to the shaft 16.

Projecting outwardly from the front face 17B of the launching head 17 is a beak 20 having a laterally extending nose 20A. The purpose of the beak 20 and nose 20A is to impart to the target wing 12 an unpredicable, irratic flight path as the target is released from the launching head to simulate a flight of a game bird.

Disposed to opposite sides of the beak and projecting outwardly from the front face 17B of the launching head are a pair of finger means 21—21. As shown in FIGS. 1 to 3, each finger means 21 includes a mounting shank portion 21A which is adapted to be snugly received in a bore 22 formed in the face of the head 17. A set pin 23 secures the finger means 21 in the set position.

Connected to the shank portion 21A and laterally disposed is a finger portion 21B, and which finger portion 21B is spaced from the front face 17B.

As best seen in FIG. 3 the respective finger portions 21B—21B of the finger means are oppositely disposed and turned slightly inwardly toward one another so as to slightly overlap the marginal edge portions of the propeller wing shaped target 11.

To retain the wing shaped, air-foil 11 between the finger means 21—21 when such target is loaded onto the beak 20 and to provide for automatic release of the target, there is provided a resilient detent means 24. The detent means 24 comprises a ball detent 24A which is normally biased outwardly of the front face 17B by a spring 24B. As shown in FIGS. 1, 2 and 3, the front face is formed with a bore 24C in which the ball detent 24A and its spring 24B is retained. The arrangement is such that the curvature of the ball dentent 24A extends sufficiently beyond the face 17B of the head 17 so as to normally retain the marginal edges of the wing target 11 between finger portions 21B—21B. Thus, as seen in FIG. 3, when a target wing 11 is positioned on the beak 20 and placed between the opposed finger means 21—21 with the ball detent disposed adjacent a marginal edge of the air foil wing 11, and the wing is flush against the face portion 17A; the wing 11 will rotate in unison with the hub 17 when the motor 15 is energized, e.g. rotating in one direction such as counterclockwise as shown in FIG. 3. The ball detent 24A functions to retain the target wing 11 in holding position between finger portions 21B—21B as the motor is rotating to impart a rotational momentum to the target prior to release. The ball detent 24A also functions to retain the target wing 11 in place should an operator desire for some reason to stop the rotation of the motor shaft 16 with the target 11 still in place of the hub 18A or launch head 17.

To effect release of the air foil target 11 and its cap 12 from the launch head, the motor 15 is reversed. In reversing the motor 15, the rapid change of direction, i.e. from counterclockwise to clockwise, as viewed in FIG. 3, causes the head or hub 17 to be rotated opposite to the rotation of the target 11, thereby causing the target 11 to override the ball detent 24A to become free of the holding finger portions 21B—21B. The rotation imparted to the target 11 and becoming free of the fingers 21—21 upon reversal of the motor 15 as described causes the target to fly off the beak 20. In departing from the beak, the nose portion 20A being laterally disposed will cause the target 11 to be laterally deflected. Thus the shape of the propeller shaped air foil 11 and the manner in which the target is launched imparts thereto an unpredictable and irratic flight which simulates the flight of a game bird.

To further vary the point of release of the target, means are provided for oscillating the motor mount through a predetermined arcuate segment in as muth. This is provided by incorporating an oscillating drive motor 30 in the support base 13 and connecting the drive motor 30 through an eccentric connecting link to the rotatable motor mount 14. The oscillating means as disclosed herein is similar to that described in my co-pending application Ser. No. 239,972, filed Mar. 3, 1981, entitled Improved Target Pigeon Launcher. Essentially it includes the drive motor 30 having an output shaft 31 connected to the input 32 of a gear reducing unit 33. The output 34 of the gear reducing unit 33 is connected to a disk 35. A connecting link 36 is eccentrically connected to the disk 35. The other end of the link 36 is pivotally connected to a drive disk 37 which is journalled or fixed to the motor mount 14. Thus, it will be apparent that when the drive motor 30 is actuated it will effect the drive of the motor mount 14 in an oscillating manner.

Figure 4:
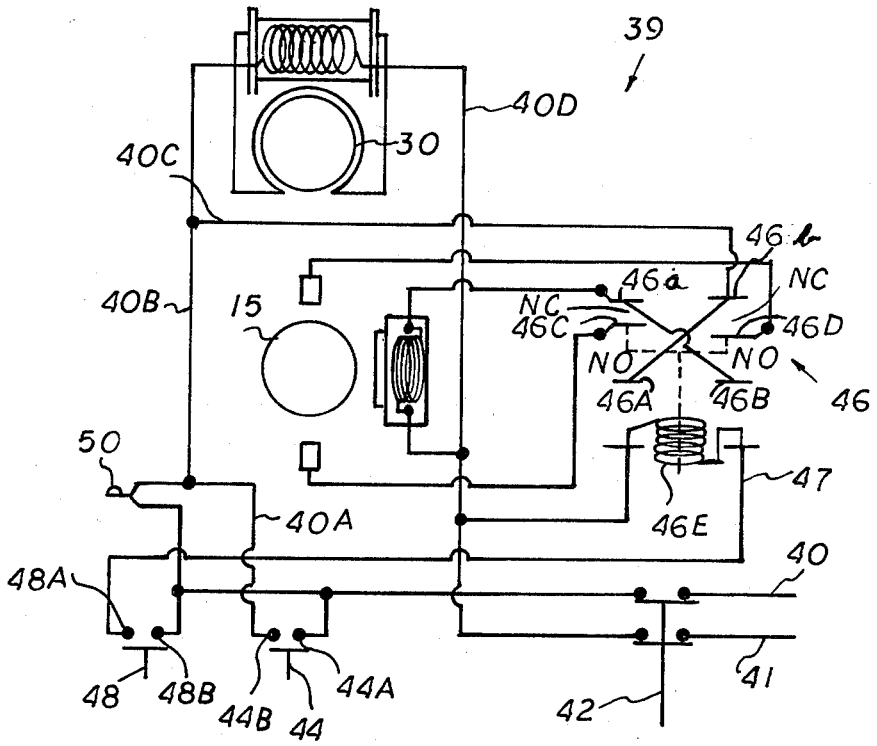
FIG. 4 is a schematic wiring diagram of the control circuit for actuating the launcher.

Referring to FIG. 4, there is illustrated a schematic wiring diagram 39 to illustrate the manner in which the launcher 10, herein described, can be cntrolled. As shown, leads 40 and 41 are connected to a suitable source of electrical energy e.g. a 110 v. source of alternating current. Disposed in the leads or lines 40, 41 is a main cut-off or safety switch 42. The main cut-off switch 42 is physically located adjacent to the launcher 10 so that the person loading the target 11 onto the launcher 10 can physically cut the power to the launcher to provide for absolute safety in loading the launcher 10. When the target 11 is properly placed on the launch head 17 of the launcher 10, the safety switch 42 is closed. Connected in circuit with the safety switch 42 is an indicating lamp 50. As shown, the indicating lamp 50 is energized whenever the safety swtich 42 is closed. It will be understood that the indicating lamp 50 is disposed so as to be visible to the person controlling the actuation of the launcher 10. A first actuating means or start button, or switch 44 is provided. Switch 44 is a normally open switch having one contact 44A connected to lead 40 and having its other contact 44B connected by lead 40A which bi-passes the lamp 50 to send energizing current to the main motor 15 and the oscillating motor 30 through leads 40A, 40B, 40C, 40D and back to ground eg lead 41 when the start switch 44 is closed.

In accordance with this invention, the circuit to the main motor 15 includes a means for reversing the polarity of the motor 15 to control the direction of rotation of its motor shaft 16. In the illustrated embodiment the means includes a relay 46 having two pairs of fixed contacts, eg **46*a*, 46*b* and 46A, 46B and a pair of movable contacts 46C and 46D; arranged to engage with contacts 46*a*, 46*b* or 46A, 46B, sequentially. The movable contacts 46C, 46D are shifted in response to the actuation of the relay coil 46E. In the illustrated embodiment the relay coil 46E is connected by lead 47 to one contact 48A of a firing switch 48 and the other contact 48B being connected to lead 40. Normally, contacts 46*a*, 46*b* are closed with contacts 46C and 46D respectively, and contacts 46A, 46B are normally open relative to the movable contacts 46C, 46D. While a relay 46 is illustrated as the means by which the motor 15** is actuated to effect the reversal thereof, it will be understood that electrical solid state type devices may be used to the same end.

In operation, with the main cut off switch 42 open, current to the motors 15 and 30 of the launcher is cut off thus rendering it safe for the loader to load the launcher 10 with a target 11. With the target 11 positioned on the launcher head, the loader closes the safety or main switch 42. Upon closing off the main switch 42, the indicating lamp 50 is energized indicating that the launcher has been loaded.

To impart rotation to the target, the start button or switch 44 is closed. The start button is preferably of a spring loaded type that must be manually depressed and held in the close circuit position. In closing the start switch 44, energizing current is directed to the reversible motor through contacts **46*a*, 46*b* closed with contacts 46C and 46D whereby the motor shaft is rotated to impart rotation to the target 11 secured to the launch head 17. Also current is directed to the drive motor 30 which will oscillate the motor mount 14 and connected motor 15 through a predetermined angular distance. When the revolution of the motor 15 reaches a desired speed, the firing button or switch 48 is closed while maintaining the start switch 44 closed. Closing of the firing switch 48 will close the circuit to the relay coil 46E, which comprises an electromagnet coil 46E, causing the contacts 46C and 46D to disenergize contacts 46*a* and 46*b* and to energize or close with contacts 46A and 46B. When contacts 46A and 46B are thus energized, the current flow through the motor 15 is reversed causing the motor shaft to reverse its direction of rotation. In doing so, the inertia resulting from the changing of direction of the motor 15 causes the launch head to be moved relative to the wing shaped target 11 an amount sufficient for the target wing 11 to override the ball detent 24A and thus become free of the holding fingers 21B—21B. Being thus free of the fingers 21B—21B, the propeller shaped wing target 11, due to the rotational energy imparted thereto, will cause the target to fly off the end of the beak 20. The nose portion 20A being laterally disposed will also impart a lateral momentum to the target as it leaves or separates from the beak 20**.

Upon the target 11 being fired, the start switch 44 and firing switch 48 are released or opened to thereby ready the launcher for reloading. To reload, the loader opens the safety switch 42 and another target 11 is loaded onto the launcher. With the new target loaded on the launch head 17, the safety switch 42 is closed and the cycle is repeated.

In the event the motor 15 is required to be shut down or stopped before the target 11 is released, the start button or switch 44 is released or opened thereby opening the energizing circuit to the motor 15.

The ball detent 24A, as the motor is winding down to stop, causes the target 11 to maintain its relative position to the hub 18A, and thus prevents the target from becoming free or loose from the hub on shut down.

From the foregoing description it will be apparent that the release of the target is simply effective by a reversal of the launching motor 15. Also the construction is such that the propeller or target 11 is retained to the launch head if for any reason the launcher is required to be de-energized before the firing switch 48 is closed.

While the invention has been described with respect to a particular embodiment, it will be understood that variations and modifications may be made without departing from the scope or spirit of the invention.

What is claimed is:

1. A launcher for launching a target comprising:
a base means defining a support,
a motor mount on said base means,
a reversible motor mounted on said motor mount,
said reversible motor having a motor shaft,
a launcher head connected to the end of said motor shaft, and
holding means on said launcher head for releasably securing a target thereto whereby a target is retained on said launcher head when said motor shaft is being rotated in one direction and whereby a target is released when said motor is reversed.

2. A launcher as defined in claim 1 and including a control circuit for actuating said reversible motor, said circuit including means to reverse the polarity of said motor to control the direction of rotation of said motor, and switching means connected in circuit to said reversing means for activating said reversing means to control the direction of rotation of said motor.

3. A launcher as defined in claim 1 and including means connected to said motor for oscillating said motor relative to said base means.

4. A launcher as defined in claim 3 wherein said oscillating means comprises a motor drive having a drive shaft, and an eccentric crank arm interconnected between said motor drive and said reversible motor for effecting the oscillation of said reversible motor relative to said motor mount.

5. A launcher as defined in claim 1 wherein said launcher head comprises a hub having a face portion, a projecting beak extending outwardly of said face portion, and said holding means includes a pair of oppositely disposed retainer means projecting outwardly of said face portion to either side of said beak and directed toward one another,
each of said retainer means having a finger portion arranged to overly a marginal portion of a target,
when a target is positioned on said beak, a resiliently loaded detent for maintaining a target secured between said finger portions as said motor is rotating in one direction and for effecting the release of a target when said motor is reversed.

6. A launcher as defined in claim 5 wherein said detent includes a detent ball having a surface portion thereof projecting beyond the plane of said face portion, and a spring for normally biasing said ball detent outwardly from the plane of said face portion.

7. A launcher for a target pigeon having a propeller shaped wing and a detachable cap comprising:

a base means defining a support, a motor mount rotatably journalled on said base means, a motor housing containing a reversible motor mounted on said motor mount, said motor having a motor shaft, a launch head connected to the end of said motor shaft;

said launch head including a hub fixed to said shaft and having a face portion;

a beak means on said head projecting forwardly from said face portion for imparting an erratic, random flight to a target having a laterally extending nose projecting forwardly of said face portion, holding means on the face portion of said launch head adapted for releasably holding a propeller shaped wing on said beak means, said holding means including a pair of oppositely disposed finger adapted to engage a propeller shaped wing therebetween, a releasably detent adapted for biasing a wing between said fingers as said motor is rotated in one direction, a control circuit for energizing said motor, said control circuit including means for reversing the polarity of said motor to control the direction of rotation thereof, an actuating means disposed in said control circuit for energizing said motor to effect the rotation thereof in one direction and a second actuating means disposed in said circuit to reverse the rotation of said motor when said second actuating means is actuated.

8. A launcher as defined in claim 7 and including a means for oscillating said motor mount and connected motor housing in asmuth about said base means, said oscillating means including a drive motor wired in said control circuit; and an eccentric crank arm interconnected between the output of said drive motor and the input of said motor mount whereby the rotation of said drive motor effects oscillation of said motor mount and connected motor housing.

9. A launcher for launching wing shaped targets comprising:

a reversible motor having a motor shaft, a hub connected to the end of said shaft, a beak means for imparting erratic, random flight to a target projecting forwardly of said hub adapted for receiving a target, means on said hub adapted for releasably retaining a target thereto when said motor is rotating in one direction and for effecting the release of a target when the motor is reversed, and a control circuit for controlling the rotation of said motor, said control circuit including a safety cut off switch to interrupt the circuit to said motor, an indicating light connected in circuit with said cut-off switch for indicating when said cut-off switch is closed and said motor is readied for operation, a first actuating means connected in said circuit to said motor for energizing the motor circuit to effect the rotation of said motor shaft in one direction, a second actuating means disposed in said circuit for initiating rotation of the motor shaft in the opposite direction, means disposed in said circuit responsive to the actuation of said second actuating means to reverse the polarity of said motor whereby the direction of rotation of said shaft is reversed to effect the release of a target.

10. A launcher as defined in claim 9 wherein said mens for releasably retaining a target to said hub includes a pair of oppositely disposed fingers, said fingers being oppositely directed toward one another, and a resiliently loaded detent adapted for normally holding a wing shaped target between said fingers when the motor shaft is rotating in one direction, and whereby the inertia resulting from reversal of said motor causes said target to override said detent to cause a target to be released from said fingers.

* * * * *